United States Patent [19]

Takahashi et al.

[11] Patent Number: 4,511,778

[45] Date of Patent: Apr. 16, 1985

[54] IMAGE FIXING DEVICE UTILIZING A HIGH FREQUENCY WAVE

[75] Inventors: Tohru Takahashi, Tokyo; Hatsuo Tajima, Matsudo; Michio Shigenobu, Tokyo; Shigemichi Washiyama, Kawasaki, all of Japan

[73] Assignee: Canon Kabushiki Kaisha, Tokyo, Japan

[21] Appl. No.: 327,688

[22] Filed: Dec. 4, 1981

[30] Foreign Application Priority Data

Dec. 11, 1980 [JP] Japan ..... 55-174892
Dec. 11, 1980 [JP] Japan ..... 55-174904

[51] Int. Cl.[3] ..... H05B 6/78; G03G 15/00

[52] U.S. Cl. ..... 219/10.55 A; 219/10.55 F; 355/3 FU

[58] Field of Search ..... 219/10.55 A, 10.55 F, 219/216; 355/3 FU, 3 SH, 14 FU, 14 SH; 333/248, 246, 252; 343/767, 768, 700 MS

[56] References Cited

U.S. PATENT DOCUMENTS 3,263,052 7/1966 Jeppson et al. ..... 219/10.55 A
4,160,145 7/1979 Rueggeberg ..... 219/10.55 A X
4,187,405 2/1980 Püschner et al. ..... 219/10.55 A
4,210,793 7/1980 Fournet-Fayas ..... 219/10.55 F
4,211,987 7/1980 Pan ..... 333/246 X
4,320,952 3/1982 Seimiya et al. ..... 355/3 FU
4,399,341 8/1983 Yasuoka ..... 219/10.55 A X

FOREIGN PATENT DOCUMENTS 49-38171 10/1974 Japan .
52-20039 2/1977 Japan .
54-10865 5/1979 Japan .

*Primary Examiner*—Philip H. Leung
*Attorney, Agent, or Firm*—Fitzpatrick, Cella, Harper & Scinto

[57] ABSTRACT

A dielectric or induction heating fixing device utilizing a high-frequency wave such as microwave for fixing an unfixed image on an image bearing member stabilizes the fixing effect in accordance with the size of the image bearing member. A control device controls the applied high-frequency wave in accordance with the size of the image bearing member, a conveyer conveys one side edge of the image bearing member of each size along a conveyance standard or reference, and a device regulates the area to which the high-frequency wave is applied, in accordance with each size. In a preferred embodiment, there is provided a control device for controlling the applied high-frequency wave so that the fixativeness of the unfixed image after the image bearing member has passed the area to which the high-frequency wave is applied becomes equal irrespective of the size of the image bearing member.

36 Claims, 16 Drawing Figures

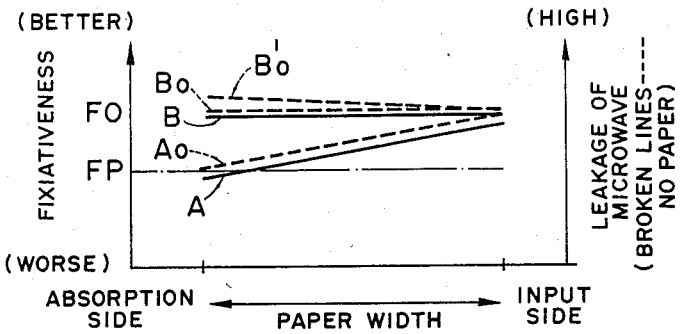
FIG. 4
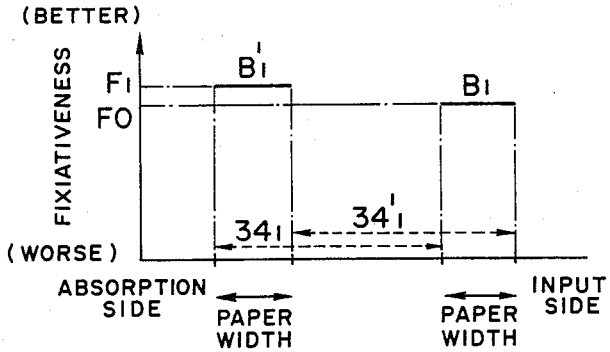
FIG. 5
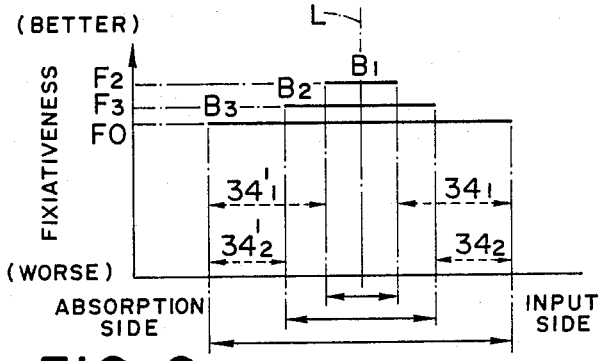
FIG. 6
FIG. 7
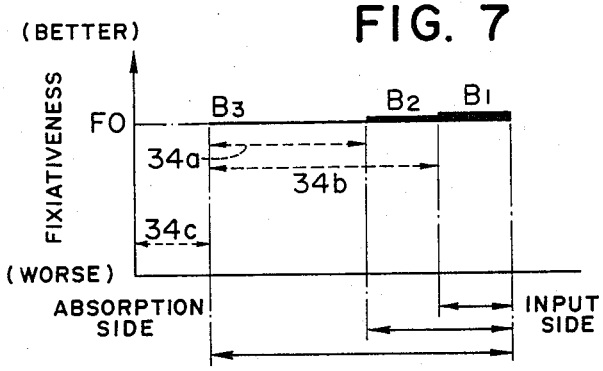

IMAGE FIXING DEVICE UTILIZING A HIGH FREQUENCY WAVE

BACKGROUND OF THE INVENTION

1. Field of the Invention

This invention relates to a fixing method and device in which a high-frequency wave such as microwave is applied to fix an unfixed image such as a toner image on an image bearing member such as plain paper to thereby form an image thereon, and more particularly to a fixing method and device for heating by electromagnetic wave image bearing members of various width sizes bearing an unfixed image thereon while conveying such image bearing members.

2. Description of the Prior Art

In image formation apparatus wherein a developed image formed on an image bearing member by an image formation method such as electrophotographic method is transferred onto an image bearing member such as plain paper and the transferred image is heated and fixed to provide a fixed image, there has heretofore been proposed a system for fixing unfixed image by microwave heating.

Such heating-fixing method using a high-frequency wave such as microwave and a device therefor have already been disclosed in Japanese Patent Publication No. 38171/1974, Japanese Laid-open Patent Application No. 20039/1977 and Japanese Patent Publication No. 10865/1979. This high-frequency wave heating-fixing device is an excellent one which has eliminated the following disadvantages in the so-called extraneous heating and fixation. That is, it is a compact device which reduces the wait time until a temperature necessary for fixation is reached, which eliminates the danger of a fire or the like occurring when a recording medium such as paper stays within the fixing area by some cause or other, and which prevents creation of wrinkles and disturbance of image which would otherwise result from the contact of the recording medium with a heating roller or the like.

However, a device which can provide a uniform and good heating-fixing effect without requiring cumbersome adjustments where the width sizes of unfixed image bearing members are various is not yet known. In the prior art system, when the fixing device is constructed so as to conform to the fixation of an image bearing member of a maximum width size, excessive fixation may occur in the case of image bearing members of small sizes, that is, developer may become excessively fluidized to disturb the image or the image bearing members may become too dry and degenerated or sometimes scorched. On the other hand, when the fixing device is constructed so as to conform to a maximum size, unsatisfactory fixation may occur in the case of image bearing members of large sizes and fixativeness may be lost.

However, the width dimension of the image bearing member having thereon an unfixed image to be fixed is not constant but various. Therefore, in the case of fixation of an image bearing member of a small width dimension, wasteful high-frequency wave energy which does not contribute to fixation would be put out and this is not preferable in terms of energy saving. Also, no recording medium is present in the portion which does not contribute to fixation, so that the neighborhood of the fixing device is heated by leakage high-frequency wave to thereby increase the ambient temperature, and this is not preferable in terms of the rise of the temperature within the apparatus.

SUMMARY OF THE INVENTION

It is an object of the present invention to provide a novel fixing device which solves problems in various sizes of image bearing members in a fixing device to which a high-frequency wave is applied.

It is another object of the present invention to provide a fixing device which is capable of fixing an unfixed image satisfactorily irrespective of the width size of an image bearing member bearing an unfixed image thereon.

It is still another object of the present invention to provide a fixing device which is capable of applying a sufficient high-frequency wave to any kind of image bearing member bearing an unfixed image thereon and preventing any excess high-frequency wave.

Other objects and features of the present invention will become fully apparent from the following detailed description thereof taken in conjunction with the accompanying drawings.

BRIEF DESCRIPTION OF THE DRAWINGS

FIG. 4 illustrates the fixing effect along the widthwise direction of the conveyance path.

FIG. 5 illustrates variations in the fixing effect caused by variations in the position in which an image bearing member is passed.

FIG. 6 illustrates the fixing effect when an image bearing member is conveyed while being parted in the center.

FIG. 7 illustrates the fixing effect in an example of the construction of the present invention.

DESCRIPTION OF THE PREFERRED EMBODIMENTS

Figure 1:
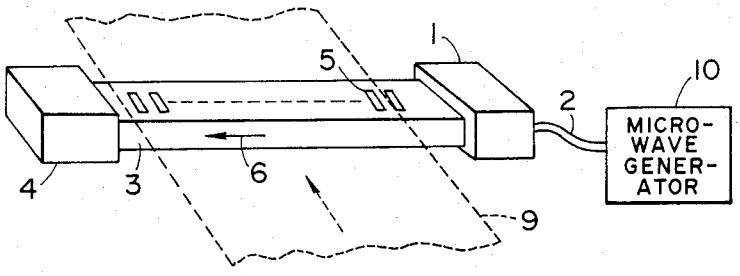
FIG. 1 is a schematic view illustrating a fixing device of the microwave heating type according to the present invention.

In the drawings including FIG. 1, reference numeral 1 designates a microwave input device which may comprise microwave generator means such as a magnetron directly disposed or which may be designed such that the microwave generated by microwave generator means 10 is directed by a coaxial cable 2, as shown. Designated by 3 is a microwave guide path disposed transversely of the conveyance path of an unfixed image bearing member such as transfer paper and having one end connected to the microwave input device 1. As the guide path 3, a desired one such as a hollow guide tube or a microstrip type dielectric member and an electrode which guides microwave may be chosen (as will hereinafter be described in detail). Reference numeral 4 denotes a microwave absorbing member which may be water or the like. This absorbing member is not requisite, but it displays the effect of preventing the generation of standing wave in the guide path by reflection of microwave and eliminating the possibility of fixation irregularity being caused by movement of the strength of the standing wave resulting from the presence of an image bearing member which will hereinafter be described in detail. Designated by 5 is a number of opening slits provided on the electrode of the guide path 3 for causing the interior microwave to leak to the image bearing member conveyance path. This leakage microwave is absorbed by the unfixed developer on the image bearing member or by the developer and the image bearing member and creates the heating by dielectric loss to cause the developer to be melted and fixed.

Figure 2:
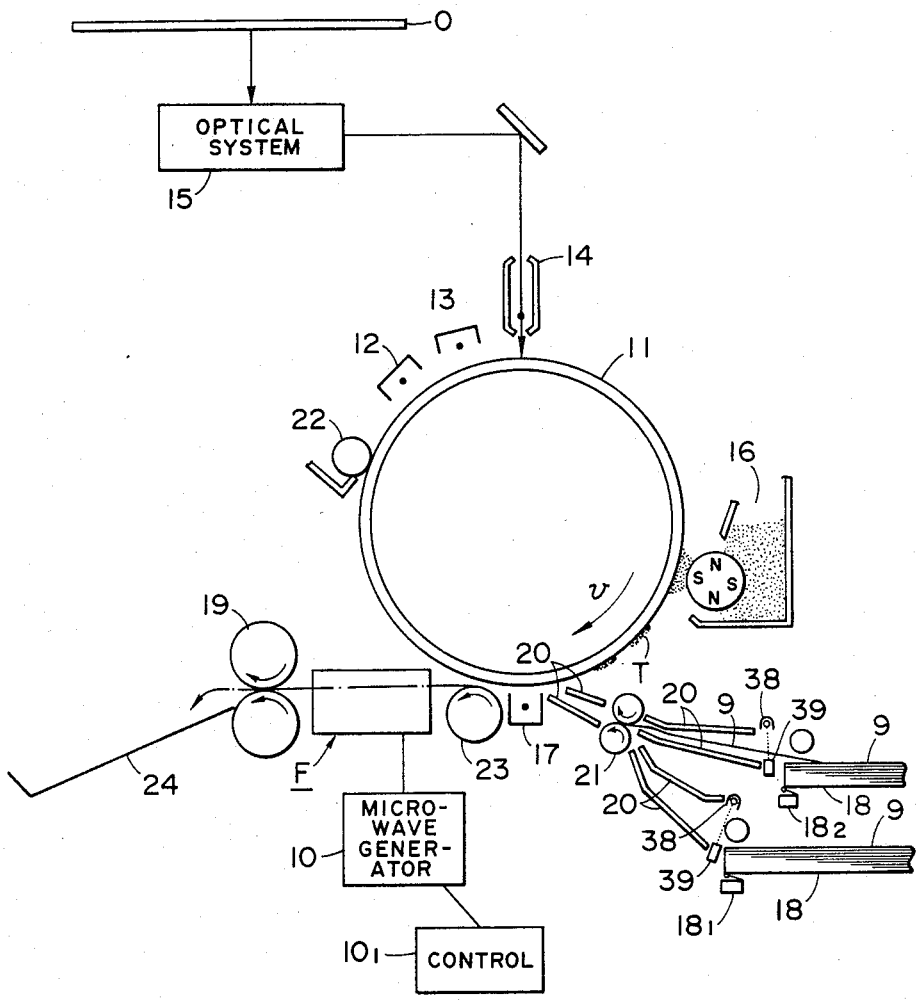
FIG. 2 illustrates an example of an electrophotographic image formation apparatus to which an embodiment of the present invention is applied.
Figure 3A:
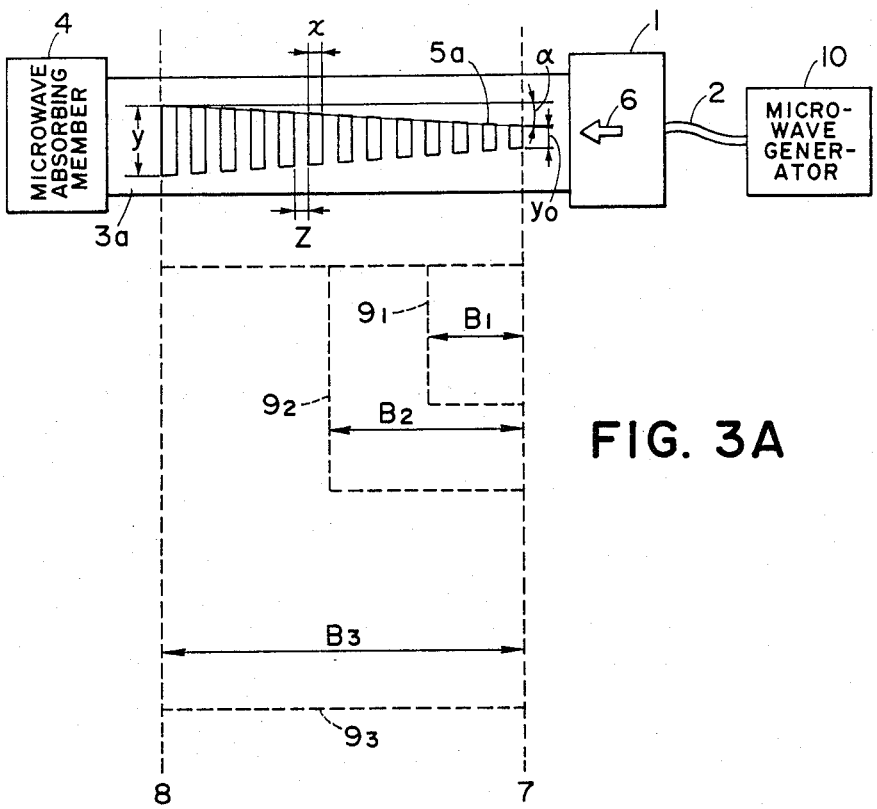
FIGS. 3(*a*), (*b*) and (*c*) illustrate the constructions of specific examples of the present invention.
Figure 3B:
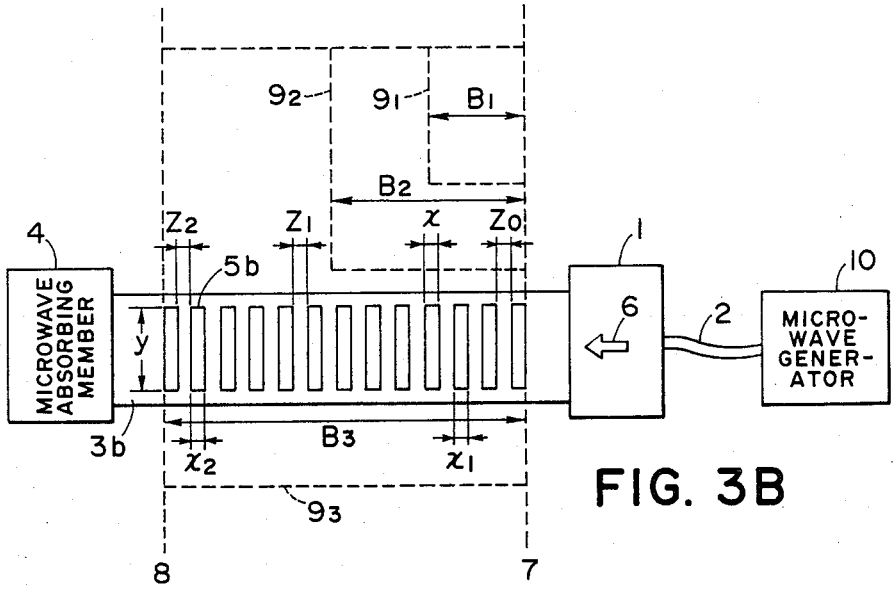
Figure 3C:
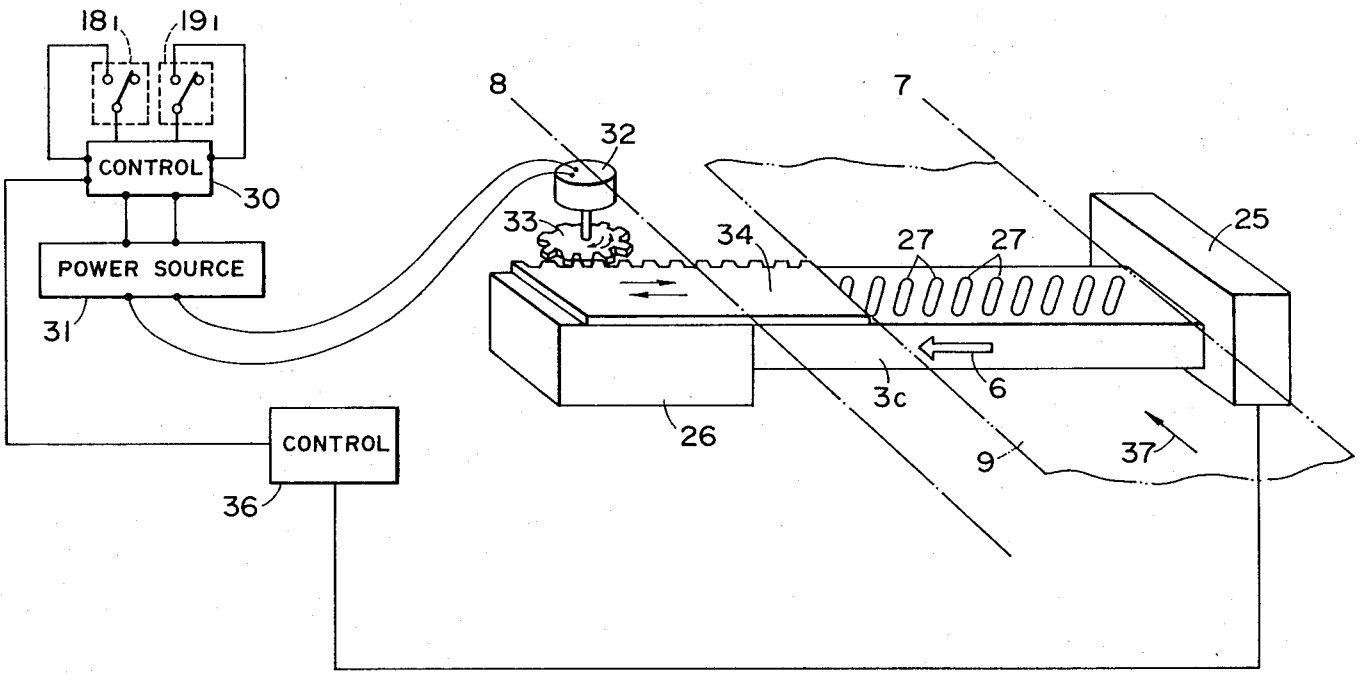

FIG. 2 shows an arrangement in which a microwave application device (see FIGS. 3(*a*) and (*b*), 8, 9 and 11(*a*), (*b*) and (*c*)) having the guide path 3 as shown in FIG. 1 is provided in the fixing station F of a well-known electrophotographic image formation apparatus. As is well known, a photosensitive drum 11 having a photosensitive layer on the surface thereof is rotated at a velocity v in the direction of arrow by the drive force of a drive source (not shown) in response to a copy signal, and is pre-discharged by a pre-discharging charger 12. Subsequently, the photosensitive drum 11 is charged by a primary charger 13, and then is subjected to secondary discharge by a secondary charger 14. On the other hand, simultaneously therewith, the image of an original O is scanned by an optical device 15 including an optical member and optical member moving means (or alternatively, the optical device 15 is fixed and the original O or an original carriage (not shown) is moved), whereby image exposure is effected on the photosensitive drum 11 at a certain magnification (one-to-one magnification, reduction or enlargement). Subsequently, the drum 11 is subjected to whole surface exposure, whereby an electrostatic latent image is formed on the drum 11. This latent image is developed into a visible image T by a developing device 16 and is rotated with the drum 11 to arrive at an image transfer charger 17.

On the other hand, the image bearing member 9 assumes a conveyance form in which it is conveyed so that one side edge of each size goes along a standard line (such as the standard line 7 of FIG. 3). The form in which the image bearing member 9 is conveyed so that one side edge thereof goes along the standard or reference line will hereinafter be referred to as the one side standard or reference conveyance or the one side standard.

A form in which the image bearing member 9 is conveyed so that the central portion of one side edge thereof which lies in a direction intersecting the direction of conveyance of the image bearing member 9 goes along the standard line will hereinafter be referred to as the central standard conveyance or the central standard.

It is for the purpose of causing the electrostatic latent image on the photosensitive drum to be carried by the image bearing member 9 and for the purpose of disposing at a predetermined position separating means for separating the image bearing member 9 electrostatically attracted to the photosensitive drum that the image bearing member 9 is conveyed so as to be along a certain standard.

In any case, the image bearing member 9 is conveyed on a predetermined conveyance standard from a cassette 19 or the like, and in the present embodiment, the image bearing member 9 is conveyed on the one side standard. The image bearing member 9 is moved along a guide member 20 and conveyed into proximity to the drum 11 with a timing taken by register rollers 21 in order to receive the visualized image T. Subsequently, the image bearing member 9 is charged to a polarity opposite to the visualized image T from the back side thereof by an image transfer charger 17, whereby the visualized image T is transferred onto the image bearing member 9. Thereafter, the photosensitive drum 11 has its surface cleaned by a cleaning roller 22, thus becoming ready for the next cycle of copying.

On the other hand, the image bearing member 9 now positively bearing the visualized image T thereon is separated from the photosensitive drum 11 by separating means. An example of this separating means may be a separating roller 23 (or a separating belt, not shown) provided in the conveyance standard of the image bearing member. In the present embodiment, the separating roller 23 is provided adjacent to the photosensitive drum 11 on the one side conveyance standard side.

The image bearing member 9 so separated is conveyed to the fixing station F proximate to the photosensitive drum 11 by the conveyance force of the separating roller 23, well-known conveyor means or the like. At the fixing station F, the visualized image T is caused to dielectrically heat by the microwave generated by the microwave generator means 10 and is fixed as an image on the image bearing member 9.

The visualizing agent (or toner) constituting the visualized image T uses a dielectric substance, an electrically conductive substance or a magnetic substance as the chief component, and these substances generate heat due to eddy current loss, dielectric loss, hysteresis loss, residual magnetism loss or the like depending on a certain frequency area.

In FIG. 2, reference numeral 10, designates control means which is a major component of an embodiment of the present invention. As described above, the microwave generated by the microwave generator means 10 is of a frequency providing such a degree of energy which enables the visualized image T to be fixed, and it is generated by an applied voltage which provides that amount of energy. However, the high-frequency wave such as the microwave which provides such fixativeness is varied in necessary amount of energy by the material, size, etc. of the image bearing member used (as will later be described) and therefore, the control means $\mathbf{10}_1$ is provided so as to provide a high frequency wave corresponding thereto.

This control means 10, effects at least one of the output control, the frequency control and the applied voltage control of the generator means 10 in accordance with the visualized image or the image bearing member 9.

The image bearing member 9 having the image thus transferred thereto is discharged by paper discharge rollers 19 into a tray 24 projected outwardly of the image formation apparatus.

The present invention will be described in greater detail by comparing the case of an embodiment thereof in which the wave guide path 3 as shown in FIG. 1 is used in the fixing station F of such an image formation apparatus with a case where the wave guide paths 3*a*, 3*b* and 3*c* of FIGS. 3(*a*), (*b*) and (*c*) which are further preferred embodiments of the present invention are used in the fixing station F.

FIGS. 4 to 7 are illustrations (also available for embodiments hereinafter described) corresponding to this comparison. In these figures, the horizontal axis represents the distance along the wave guide path and the vertical axis represents the fixativeness. The fixativeness has been determined by actually passing a sheet of paper bearing an unfixed image thereon through the fixing station F, thereafter rubbing the paper with cloth or the like and judging the fixativeness from the manner in which the toner peels off the paper.

The constructions of FIGS. 3(*a*) and (*b*) will first be described. In FIG. 3(*a*), members common to FIG. 1 are designated by identical reference characters. Reference characters 5*a* and 5*b* designate improved slit openings and reference characters 3*a* and 3*b* denote wave guide paths. Reference numeral 7 designates a standard line showing the one side standard of the aforementioned conveyance standards, and it is positioned on the microwave input device side. Reference numeral 8 designates a standard line showing the other end area of the feed width of an image bearing member of a maximum size from the standard line 7. The slit openings 5*a* and 5*b* are provided between these standard lines 7 and 8. Reference numerals $9_1$, $9_2$ and $9_3$ designate sheets of paper represented by the image bearing member. The paper $9_1$ of a minimum size has a minimum feed width $B_1$, the paper $9_2$ of a medium size has a medium feed width $B_2$, and the paper $9_3$ of a maximum size has a maximum feed width $B_3$. These image bearing members $9_1$, $9_2$ and $9_3$ are conveyed so that one side edge thereof goes along the standard line 7. The slits 5*a* have the length thereof gradually increased in the direction from the standard line 7 to the standard line 8, namely, in the direction of travel of the microwave, at such an angle $\alpha$ that [(slit length $Y_0$ at side edge 7)$+2 \sin \alpha = Y$]. The slit width X and the distance between adjacent slits are substantially equal with respect to each slit, and the slits are at equal intervals with respect to the width direction of the paper and perpendicular to the direction of movement of the paper.

Description will now be made of FIG. 3(*b*) which is about the same in construction as FIG. 3(*a*) with the only exception of slit openings 5*b*. The slit openings 5*b* of the wave guide path 3*b* are varied in density but constant in slit length Y and slit width X, the slit intervals being gradually decreased from the interval $Z_0$ on the standard line 7 side with the slit interval at the portion of width B being $Z_1$ ($<Z_0$) and the slit interval on the standard line 8 side being $Z_2$ ($<Z_1$).

The slit openings are not restricted to the forms shown above, but a combination of slit openings 5*a* and 5*b*, or a form of slit openings in which the slit width X is gradually increased such that the slit width is $X_1$ on the side edge 7 and $X_2$ ($>X_1$) on the other side edge 8, or an arbitrary combination of these slit openings, or slit openings of various shapes are also applicable to the present invention.

The constructions of FIG. 3 are for the purpose of solving the following problems. In the wave guide path 3 of FIG. 1 wherein the slits 5 have a uniform distribution and shape in the lengthwise direction, the energy of microwave is weakened due to its leakage or its absorption into paper or the like during the process in which it propagates in the direction of arrow 6 from the input side whereat the microwave input device 1 lies, and it is absorbed and converted into heat when it arrives at the absorbing member. Therefore, the leakage microwave is usually strong and fixativeness is great on the input side, while fixativeness is liable to be small on the absorption side. In order to overcome such non-uniformity, it is effective to gradually increase the size or density of the slits on the absorption side as shown in FIG. 3(*b*). FIG. 4 shows this relation. In FIG. 4, the right-hand vertical axis represents the high-frequency wave output characteristic when no paper passes through the device, and the data therefor are indicated by broken lines, and the data for the fixativeness represented by the left-hand vertical axis are indicated by solid lines. Broken line $A_0$ and solid line A respectively indicate the microwave leakage characteristic and the resultant fixativeness in the example of FIG. 1. That is, due to non-uniformity, particularly, due to the fact that sufficient microwave is not provided on the absorption side, there is created a portion in which the fixativeness is below the best fixation point FO but substantially reaches the good fixation point FP. In other words, when the input side is in the best fixation (or excessive), the absorption side exhibits the good fixation.

In contrast, the microwave characteristics of FIGS. 3(*a*) and (*b*) become as indicated by broken line $B_0$ which keeps a uniform level in the entire wave guide path and therefore, there has been obtained solid line B which indicates a uniform and sufficient fixation level over the entire width of the paper. Again in the case of broken line $B_0'$ which means a more or less higher output on the absorption side than on the input side, there has been obtained a substantially similar effect.

FIG. 4 shows the case of paper $9_3$ of the maximum width or paper of a width approximate thereto, but when the paper width was varied, there appeared the variations as shown in FIGS. 5 and 6. That is, in FIG. 5, the inventors have found that in case B as well as in the aforementioned case B, if the width size (paper width) of the image bearing member is varied, the strength of fixation fluctuates to cause a variation in fixation. Paper width $B_1$ refers to a case where use is made of a device identical to the construction of B of FIG. 4 and the paper width is made smaller and the paper is conveyed with one side edge of the paper width $B_1$ being coincident with the standard line 7 on the input side and, in this case, the fixativeness is the same as or slightly better than the case of B, but if $B_1$ having the same paper width is brought toward the absorption side, for example, the standard line 8 side, the fixativeness becomes strong or excessive as indicated by $F_1$ to scorch or crisp the paper. This is believed to be attributable to the fact that, in the case of paper width $B_1'$, there is no paper on the input side as compared with the same location on the input side and therefore there occurs no absorption of microwave by paper or toner and correspondingly more energy has reached. FIG. 6 shows, for comparison, a case where image bearing members (paper sheets) of various sizes in which the use of the leakage on the microwave input side differs are conveyed while being parted in the center (the central standard conveyance). It is apparent that correspondingly to the various paper widths $B_1$, $B_2$ and $B_3$, the fixativeness becomes smaller in the order of $F_2$, $F_3$ and FO ($FO<F_2<F_3$, paper widths $B_1<B_2<B_3$) and thus, the fixativeness differs from one paper width to another. FIG. 7 shows the case of an embodiment of the present invention, in which paper sheets of various sizes are passed with one side edge thereof being coincident with the side edge 7 on the input side and therefore there is obtained about the same best fixativeness FO for each size. In some cases, a narrower paper width somewhat improves the fixativeness and this is considered to be attributable to the fact that the microwave along the wave guide path is reflected by the slits or the like and therefore the presence or absence of paper on the absorption side affects the fixativeness.

When the influence of the reflection of microwave is prevented or utilized as in FIG. 7, such a slight error in fixativeness may be eliminated by controlling the output or the frequency in accordance with paper size by the control means $\mathbf{10}_1$ described in connection with FIG. 2, thereby ensuring uniform fixativeness to be always obtained. In an embodiment wherein uniform or substantially uniform fixativeness is so obtained, as previously described, microwave is input from one end of the microwave guide path provided transversely of the image bearing member conveyance path to cause the microwave to leak to the image bearing member conveyance path and the image bearing member is standard-conveyed irrespective of the width size thereof so that it is exposed to and fixed by the leakage on the microwave input side, thereby eliminating the above-noted disadvantage. The reason why such uniform fixativeness is obtained is considered to reside in that the image bearing member of each size is conveyed with the conveyance standard of the image bearing member being coincident, though not completely, with one side edge of the image bearing member, whereby the cause of occurrence of any impedance change of the microwave can be eliminated to some extent. In any case, uniform fixativeness has been obtained in the above-described embodiment.

To enable image bearing members (paper sheets) of various sizes bearing unfixed images thereon to be conveyed with one side edge thereof on the input side being coincident with the standard line on the input side, the conveyance standard of the feeding device, for example, the cassette 18 or the image exposure position standard on the drum 11 by the optical member may be so constructed or, for example, after the transfer of the developed image, movement of a moving component perpendicular to the direction of conveyance of the image bearing member (paper) may be imparted to thereby properly position the image bearing member. The image bearing member is not restricted to the illustrated plain paper, but may of course be various types of transfer mediums or photosensitive mediums, as desired.

As described above in detail, the foregoing embodiment is an excellent one in which the unfixed images on image bearing members of different width sizes can be fixed uniformly and well.

In any case, to obtain a good embodiment, the conveyance standard of the image bearing member may be one side edge of the image bearing member and the conveyance path of the image bearing member may be opposite to the absorption side or the input side with respect to that standard.

Figure 8:
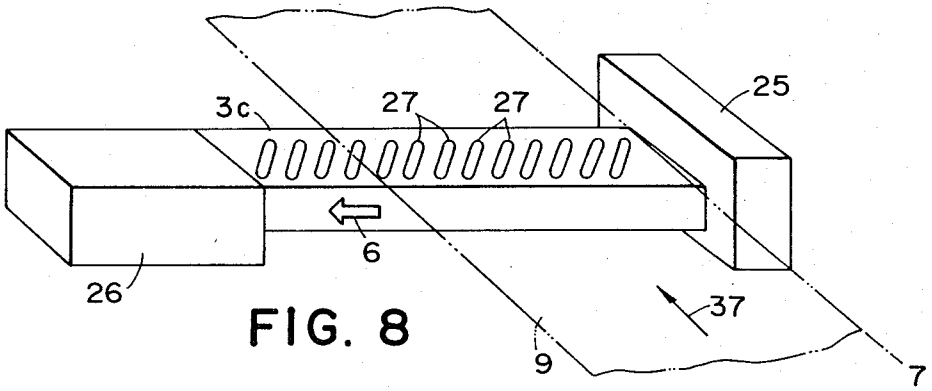
FIG. 8 illustrates another example of the construction of the present invention.

The embodiment of FIG. 3(*c*) will now be described. In FIG. 3(*c*), a wave guide path 3C shown in FIG. 8 is provided in the fixing station F. This wave guide path 3C is of rectangular cross-section, for example, and has one end connected to a high-frequency wave generation source 25 having an oscillator for generating microwave, for example, a magnetron, as shown in FIG. 8, and has the other end connected to a cooler 26 for extinguish the microwave. In the illustrated case, microwave is transmitted in the direction of the axis of the wave guide path 3C, namely, in the direction of arrow 6.

In the illustrated example, the wave guide path 3C is disposed with its axis being perpendicular to the direction of conveyance (arrow 37) of paper 9. The paper 9 advances with its underside (the reverse surface of the toner image supporting surface) being proximate to or sliding with respect to the upper surface of the wave guide path 3C and, at that time, microwave is applied to the paper. More particularly, a number of slit-like openings 27 are provided in the upper surface of the wave guide path 3C and microwave is applied to the paper 9 and accordingly to the toner image formed on the paper 9, through the slit-like openings 27. The microwave is concentratedly conducted to the vicinity of the slit-like openings and therefore, a strong high frequency field is provided on the surface portion of the slit-like openings and contributes to an improved fixing efficiency. Also, in the illustrated example, the slit-like openings 27 are so oriented that the lengthwise direction thereof is inclined with respect to the direction of conveyance of the paper 9 (for example, 45°), whereby any portion of the paper 9 passes through any portion of any of the openings 27 and therefore, microwave is applied to the paper 9 substantially uniformly over the entire width thereof.

There are two microswitches $\mathbf{18}_1$ and $\mathbf{19}_1$ on the cassette tables of the electrophotographic apparatus body shown in FIG. 2 and when cassettes are inserted into the apparatus body, the projections of the respective cassettes actuate these microswitches. The cassette sizes can be discriminated by a combination of the ON-OFF operations of the two microswitches, and for example, four cassette sizes can be discriminated for two microswitches. The signal provided correspondingly to the size of the paper used by the operation of the microswitches is processed by a control device 30, controls the power source circuit 31 of a drive motor 32, moves a shield plate 34 along the high-frequency wave guide path of the fixing device by means of a drive gear 33, and effects the slit opening-closing of the wave guide path correspondingly to the feeding width of the paper 9.

The shield plate 34 is provided so as to shield the area of the cooler 26 to which microwave is applied, and this shielded area differs for the feeding widths $B_1$, $B_2$ and $B_3$ of paper 9. Broken line arrows 34*a*, 34*b* and 34*c* in FIG. 7 indicate the areas in which leakage of microwave is prevented by the shield plate 34. The arrow 34*a* shields the portion of the cooler 26 other than the area through which paper $\mathbf{9}_2$ of medium feeding width $B_2$ passes, the arrow 34*b* shields the portion of the cooler 26 other than the area through which paper $\mathbf{9}_1$ of minimum feeding width $B_1$ passes, and arrow 34*c* shields the portion of the cooler 26 other than the area through which paper $\mathbf{9}_3$ of maximum feeding width $B_3$ passes. Also, a shield member may normally be provided in the portion on the generation source side to shield all the portion other than the areas through which the feeding widths of various sizes of paper 9 pass.

In any case, in FIG. 3(*c*), the above-described wasteful leakage on paper of narrow fixation width can be prevented to thereby improve the fixing energy efficiency and substantially reduce the output of the high-frequency wave oscillator. In this case, the control means $\mathbf{10}_1$ of FIG. 2 may be used.

In the above-described condition, the rise of the temperature within the apparatus resulting from the vicinity of the fixing device being heated by leakage of the high-frequency wave which does not contribute to fixation can be prevented.

Description will now be made of an embodiment of the present invention shown in FIG. 9 which utilizes the aforementioned variation in fixing effect in the conveyance positions of FIGS. 5 and 6.

This embodiment employs most of the constructions of FIGS. 2, 3(*c*) and 8 and the description thereof and therefore, different portions only will be described.

The developer (toner) forming the visualized image T contains an insulative component which self-heats due to the electrostatic induction phenomenon caused by application of high-frequency wave. Preferable as such material are $BaTiO_3KH_2PO_4$, polyvinylidene fluoride, polysulfide rubber, etc. having a great dielectric loss. In addition to these, the toner may preferably contain resin components ready to melt by heat, for example, components such as polyethylene, phenol resin, etc. Of course, such resin components also self-heat due to the aforementioned electrostatic induction phenomenon.

Figure 9:
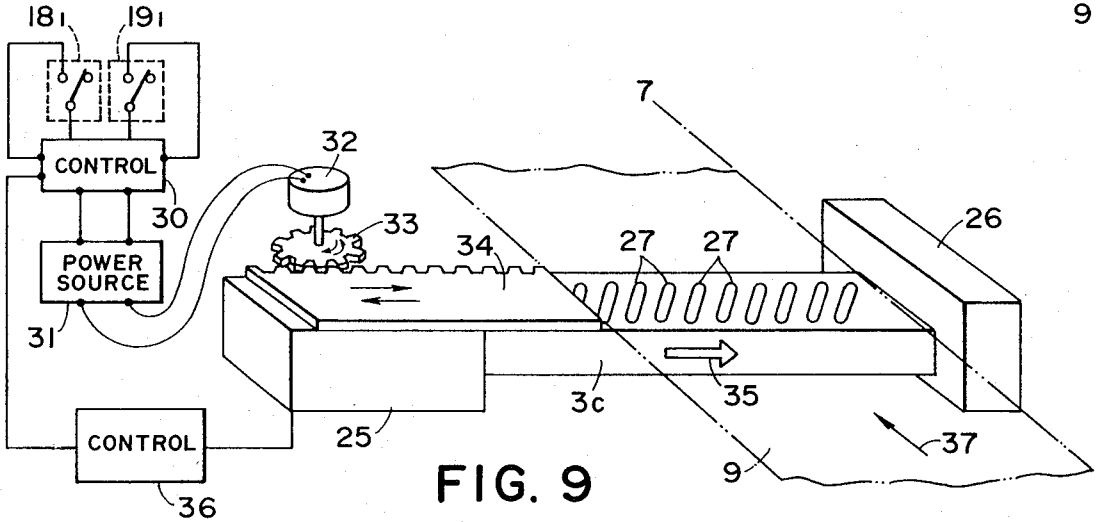
FIG. 9 illustrates another embodiment of the present invention.

The wave guide path 3C of FIG. 9 is identical to that described in connection with FIG. 8, whereas the standard line which provides the one side conveyance standard, unlike FIG. 3(*c*), is provided on the cooler 26 side. As the wave guide path of the above-described embodiments and the present embodiment, use may be made of the wave guide paths 3*a*, 3*b*, the wave guide paths 3*d*, 3*e*, 3*f* of FIGS. 11(*a*), (*b*) and (*c*) which will hereinafter be described, or a combination of these, instead of the wave guide path 3C.

Further, in the embodiment of FIG. 9, the one side conveyance standard line 7 is provided on the cooler 26 side, and microwave travels in the direction of arrow 35 from the oscillator 25 side toward the standard line 7 and the cooler side.

A shield plate 34 is provided on the microwave oscillator 25 side. Again in the present embodiment, as in the embodiment of FIG. 3(*c*), the shield plate 34 is moved by the signals of microswitches $\mathbf{18}_1$ and $\mathbf{18}_2$ or the ON signal of a copy paper designating button (well-known). The signal provided by operation of the microswitches correspondingly to the size of the paper used is processed by a control device 30, controls the power source circuit 31 of a drive motor 32, moves the shield plate 34 along the high-frequency wave guide path of the fixing device by means of a drive gear 33 and effects the slit opening-closing of the wave guide path correspondingly to the feeding width of paper 9.

On paper of narrow fixation width dimension, wasteful leakage can be prevented in this manner to thereby improve the fixing energy efficiency and substantially reduce the output of the high frequency oscillator.

In the above-described construction, the rise of the temperature within the apparatus resulting from the vicinity of the fixing device being heated by leakage of a high frequency which does not contribute to fixation can be prevented.

Movement of the shield plate 34 is effected by sliding it so as to shield the other portion than the conveyance area (or the area to which the high-frequency wave is applied) so as to correspond to the feeding width of the image bearing member (paper or the like) used.

In the above-described embodiment, the setting of the effective fixation width has been effected by determining the size of paper as the image bearing member by the information provided by the cassette, whereas the present invention is not restricted to such embodiment, but a combination of a plurality of lamps 38 and a plurality of light-receiving elements 39 may be provided in the conveyance width direction in the paper conveyance path of the copying apparatus as shown in FIG. 2 and paper may be passed between these lamps and elements so that the size of the image bearing member may be determined by the presence or absence of the image bearing member, thereby controlling the amount of high-frequency wave. Also, better fixativeness may be provided by providing control means 36 for controlling the output of the high-frequency wave generation source 25 in FIG. 9 in accordance with the above-mentioned paper size signal and utilizing the result of FIGS. 5 and 6 to generate an amount of high-frequency wave suited to the size of the image bearing member and eliminate any wasteful energy. That is, where image bearing members different in width size as shown in FIGS. 5 and 6 are simply conveyed (no standard or the central standard conveyance L), the control of the control means 36 may be made variable in accordance with paper size and may be effected as in the following example to obtain stable fixativeness irrespective of the paper size. As Embodiment 1, mention may be made of a case where image bearing members are conveyed on different standards like paper widths $B_1$ and $B_1'$ as shown in FIG. 5. In this case, by utilizing the fact that there is obtained the fixing effect $F_1$ in which the fixativeness if higher for the paper width $B_1'$ on the absorption side than for the paper width $B_1$ on the input side, the output or the frequency during the conveyance and fixation on the absorption side standard may be made smaller than that on the input side and the output may be controlled so as to satisfy the good fixation point FP. This Embodiment 1 will further be described by reference to FIG. 6. By utilizing the fact that, because of the central conveyance, the fixing effect becomes higher as the paper width size is smaller, the fixing effects $F_2$ and $F_3$ ($F_2 > F_3 > FP$) are caused to coincide with the good fixation point FP. As this control method, a set output may be pre-operated in accordance with the paper width size signal and the set output may be set to a small value in accordance with the paper width size.

As Embodiment 2, where rapid fixation is to be effected with the fixing effect set to any one of the standards $F_1$, $F_2$ and $F_3$ which are all greater than FP, a member for controlling the high-frequency wave output or the frequency or the amount of passage of high-frequency wave so as to adjust the set output to the set standard (for example, a member having a member whose dielectric constant is variable provided on the wave guide path) may be made variable to vary the fixing effect.

However, again in a case where the output control or the frequency control is effected, if an image bearing member of small width dimension is to be fixed, wasteful high-frequency wave energy which does not contribute to fixation is put out and this is not preferable in terms of energy saving. Also, the image bearing member is not present in the portion which does not contribute to fixation and therefore, the vicinity of the fixing device is heated by a high frequency wave which has leaked, to thereby increase the ambient temperature and this is not preferable in terms of the rise of the temperature within the apparatus. Consequently, it is necessary to set the effective fixation width of the fixing device to the maximum width dimension of the image bearing member used.

Accordingly, the following embodiment is directed to the solution of the above-noted inconveniences and its construction is characterized in that in a fixing device for fixing a visualized image on an image bearing member by high-frequency wave heating, there is provided control means for controlling the effective fixation width of the fixing device in accordance with the fixation width dimension of the image bearing member. Further, thereby, appropriate control of high-frequency wave energy becomes possible.

Description will now be made of an example in which, as shown in FIG. 9, a movable conductor shield plate 34 for controlling the effective fixation width is provided on the surface (or on the underside or on the vicinity thereof) of the wave guide paths 3*a*, 3*b*, 3*c* and is movably disposed in accordance with the feeding width sizes $B_1'$, $B_1$ and $B_2$ of various paper sheets as indicated by broken line arrows $34_1'$, $34_1$ and $34_2$ in FIGS. 5 and 6.

Where the paper width $B_1$ of FIG. 5 is to be conveyed on the input side edge standard the shield plate 34 is moved from the absorption side (or the input side) to entirely prevent any leakage of high-frequency wave such as microwave from the slits or the wave guide path lying in the area of broken line arrow $34_1$. Accordingly, the high-frequency wave can be controlled to such an output that the fixing effect FP is obtained only for the paper width $B_1$ while, at the same time, the influence on the optical members, the photosensitive medium, etc. in the electrophotographic copying apparatus can be greatly reduced. Also, as regards the paper width $B_1'$, leakage of high-frequency wave in the area of broken line arrow 34' can be likewise prevented.

FIG. 6 refers to the central conveyance symmetric with respect to the central standard L and therefore, as the shield plate 34, use is made of one which can be moved, in a form divided into two, from both the input side and the absorption side toward the center and in the opposite direction and which has a maximum length slightly greater than the broken line arrow $34_1$ (used in case of paper width size $B_2$). That is, design is made such that leakage of high-frequency wave in the other area than the area of the paper size to be used or fixed in the fixing area corresponding to the maximum paper width size of in the neighborhood thereof can be prevented.

Also, the method of effecting the opening-closing of the slit-like openings of the high-frequency wave guide path will be satisfactory if no high-frequency wave leaks from the slit-like openings not only by causing the conductor shield plate provided on the wave guide path as in the illustrated embodiment to move along the wave guide path but also by substantially covering the slit-like openings with a conductor or by causing a mechanism for opening-closing the slit-like openings, for example, moving plates provided in the slits, to be moved by the size signal of the image bearing member. If the present embodiment is incorporated into the embodiment of FIG. 3, there will be provided a more preferred embodiment.

Figure 10A:
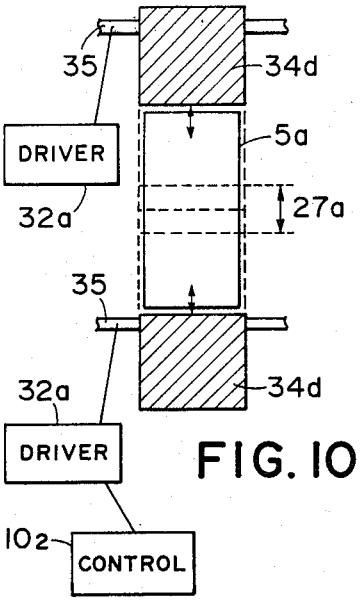
FIGS. 10A and B illustrate the opening-closing of a slit.
Figure 10B:
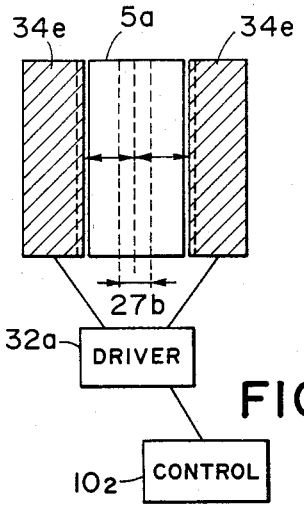

FIGS. 10(*a*) and (*b*) illustrate an example in which the slit 5*a* is opened and closed. Reference numeral 32*a* designates conventional driver means which comprises a simple mechanism such as a cam, a solenoid or a plunger and which shields a predetermined high-frequency wave leakage area by means of movable shield plates 34*d* and 34*e* in accordance with each paper width size signal. FIG. 10 (*a*) shows two upper and lower shield plates 34*d* movable lengthwisely of the slit 5*a*, and FIG. 10(*b*) shows two left and right shield plates 34*e* movable widthwisely (laterally) of the slit 5*a*. It is preferable that the differences in the shielded area (broken line arrow) are integrally coupled together as by connecting shafts 35 so that the shield plates 34*d* and 34*e* are movable in accordance with each paper size. If design is made such that all of these shield plates 34*d* and 34*e* are moved so as to leave slit openings 27*a* and 27*b* open instead of shielding the slit 5*a*, the slit openings may be controlled in accordance with each paper width size as in the embodiments of FIGS. 3(*a*) and (*b*).

As described above, according to the present embodiment, where the visualized image on paper of narrow fixation width dimension is to be fixed, the high-frequency wave energy which has leaked from the slits near the high-frequency wave oscillator can prevent any wasteful leakage which does not contribute to fixation. Thus, there can be provided an apparatus having a fixing device such as a commercial copying apparatus which is compact in design.

Figure 11A:
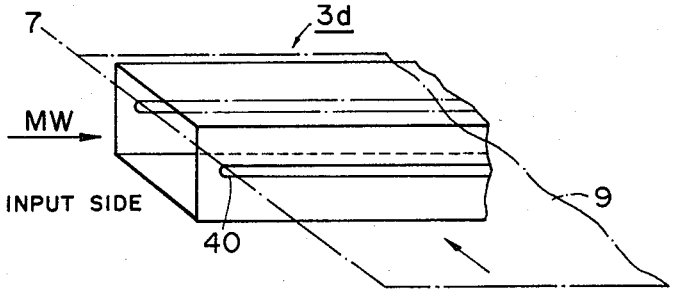
FIGS. 11A, B and C illustrate other examples of the wave guide tube (or path) usable with the present invention.
Figure 11B:
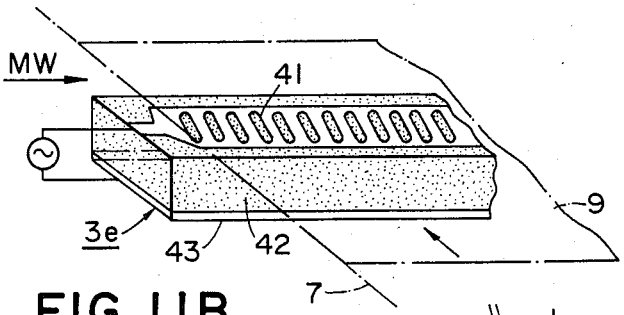
Figure 11C:
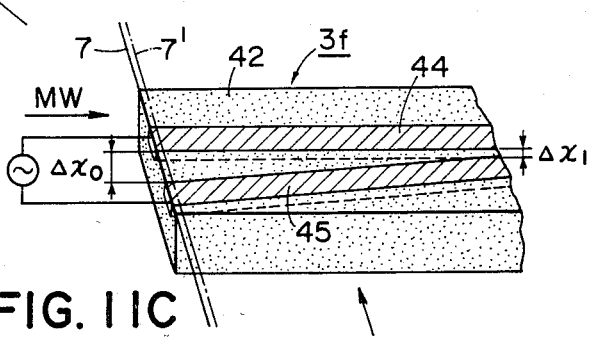

Further, if the following is utilized as the wave guide path (or tube) in each of the above-described embodiments, there will be obtained the substantially uniform B of FIG. 7. As shown in FIG. 11A, the wave guide tube 3*d* is of the type which has a slot 40 in the direction of travel MW of microwave, and paper 9 is conveyed through the slot 40 along the input side standard 7 so that the visualized image thereon is fixed. In the wave guide path 3*e* of FIG. 11B, a microstrip type dielectric substrate 42 is utilized and the microwave leakage from the slits provided in the surface conductor 41 of the substrate 42 is utilized. Designated by 43 is a conductor which provides an opposed electrode provided on the reverse surface of the substrate 42. These slits have a predetermined angle with respect to the conveyance direction of paper 9. The standard 7 is provided in the first slit on the input side. The wave guide path 3*f* of FIG. 11C comprises conductors 44 and 45 forming two electrodes on the surface of a dielectric substrate 42. This is called the slot line type in which the concentration of microwave energy between the electrodes is utilized to impart microwave to the visualized image and paper 9. The distance between these electrodes is selected such that it is $\Delta X_0$ on the input side and becomes $\Delta X_1$ ($<\Delta X_0$) toward the output side, whereby uniformization of microwave for the entire length of the wave guide path is provided. The standard 7 in FIG. 11C may preferably be positioned at the area whereat the conductors 44 and 45 on a dielectric material 42 begin, and may also be slightly deviated from that area toward the absorption side.

The input side one end of the paper may generally be coincident with the input side end of the slit group in order to effectively utilize any leakage electric (or electromagnetic) field, whereas this is not requisite but, where the paper has a non-image bearing portion caused by the separating belt or where the intensity of the electric (or electromagnetic) field leaking from the slits is reduced at the end portion of the slit group, suitable adjustment may be made such that uniform microwave energy is imparted to the necessary portion of the paper.

The present invention is applicable to both a high-frequency wave dielectric fixing device and an induction heating fixing device.

If control means $10_2$ for controlling the opening-closing of the slit portion of the present invention in accordance with the size of the image bearing member is provided to the driver means 32*a* so as to control said opening-closing in such a manner that the slit portion is not entirely opened or closed but the degree of opening thereof is variable, then there will be provided a more preferred embodiment.

What we claim is:

1. A fixing device comprising:

means defining a high-frequency wave guide for causing a high-frequency wave to travel in a direction intersecting the direction of movement of image bearing members of various width sizes bearing thereon an unfixed image formed by image formation means and for applying the high-frequency wave to said image bearing members to fix the unfixed image on said image bearing members;

means for inputting the high-frequency wave to one side of said applying means; and means for conveying said image bearing members such that one side edge of each image bearing member, regardless of its width size, moves along a common conveyance reference which intersects the travelling direction of the high-frequency wave, such that said image bearing members of various width sizes are all conveyed on one side of said common reference;

whereby substantially uniform fixation is obtained regardless of the width size of the image bearing members.

2. A fixing device according to claim 1, wherein said applying means has a region for leaking the high-frequency wave to said image bearing members along the direction of travel of the high-frequency wave in said high-frequency wave guide means.

3. A fixing device according to claim 1, wherein said conveyance reference lies at one side edge portion of said applying means whereat said input means inputs the high-frequency wave.

4. A fixing device according to claim 2, wherein said leakage region has a plurality of high-frequency wave leaking openings which are successively larger with respect to the direction of travel of the high-frequency wave.

5. A fixing device according to claim 2, wherein said leakage region has a plurality of high-frequency wave leaking openings provided at different densities with respect to the direction of travel of the high-frequency wave.

6. A fixing device according to claim 2, wherein said leakage region has electrode members provided at such intervals that they are successively smaller with respect to the direction of travel of the high-frequency wave.

7. A fixing device according to claim 2, wherein said leakage region comprises an electrode having a plurality of openings therein.

8. A fixing device according to any one of claims 1 to 7, wherein said wave guide means has a dielectric material and a conductor.

9. A fixing device according to claim 1, further comprising means for controlling the applied high-frequency wave in accordance with the sizes of said image bearing members.

10. A fixing device according to claim 2, further having effective fixation width regulating means for controlling the leakage area of the high-frequency wave in accordance with the sizes of said image bearing members.

11. A fixing device according to claim 9, wherein said control means controls a voltage applied for the generation of the high-frequency wave.

12. A fixing device according to claim 9 or 11, wherein said control means controls the frequency of the high-frequency wave.

13. A fixing device according to claim 10, wherein said effective fixation width regulating means controls the high-frequency wave leaking area on the high-frequency wave travel side of the conveyance path along which an image bearing member of a desired size among said image bearing members of various sizes is conveyed.

14. A fixing device comprising:

means for conveying image bearing members of various width sizes bearing thereon an unfixed image formed by image formation means;

means for generating a high-frequency wave;

high-frequency wave applying means for applying the high-frequency wave to said image bearing members to fix the unfixed image on each image bearing member; and means for controlling the high-frequency wave output of said generating means in accordance with the width sizes of said image bearing members;

whereby substantially uniform fixation is obtained regardless of the width size of the image bearing members.

15. A fixing device according to claim 14, wherein said control means has detector means for detecting the width of an image bearing member used in a direction perpendicular to the direction of conveyance thereof and controls said high-frequency wave output correspondingly to a signal formed by said detector means.

16. A fixing device according to claim 14, wherein said control means controls the voltage of said generating means.

17. A fixing device according to claim 14 or 16, wherein said control means controls the frequency of the high-frequency wave of said generating means.

18. A fixing device according to claim 14, wherein said applying means has high-frequency wave guide means having a region for leaking the high-frequency wave to the image bearing members.

19. A fixing device comprising:

means for conveying image bearing members of various width sizes bearing thereon an unfixed image formed by image formation means;

means for generating a high-frequency wave;

high-frequency wave applying means for applying a high-frequency wave to said image bearing members to fix the unfixed image on each image bearing member; and means for controlling the high-frequency wave applied by said high-frequency wave applying means in accordance with the width sizes of said image bearing member;

whereby substantially uniform fixation is obtained regardless of the width size of the image bearing members.

20. A fixing device according to claim 19, further comprising detector means for detecting the width of an image bearing member used with respect to the direction perpendicular to the direction of conveyance thereof and wherein said control means controls the high-frequency wave applied to said image bearing member, correspondingly to a signal formed by said detector means.

21. A fixing device according to claim 19, further comprising regulating means for controlling the effective area to which the high-frequency wave is applied, in accordance with the width of an image bearing member used with respect to the direction perpendicular to the direction of conveyance thereof.

22. A fixing device according to claim 19, wherein said high-frequency wave applying means has high-frequency wave guide means having a region for leaking the high-frequency wave to said image bearing members.

23. A fixing device according to claim 22, wherein said control means has variable means variable in accordance with the sizes of the image bearing members and controls the applied high-frequency wave from said leakage region by said variable means.

24. A fixing device according to claim 23, wherein said variable means is openable and closable and controls the applied high-frequency wave by the degree of opening thereof.

25. A fixing device according to claim 21, wherein said regulating means has cut-off means for cutting off the other area than the effective area to which the high-frequency wave is applied.

26. A fixing device according to claim 25, wherein said cut-off means cuts off the area of said applying means on the starting point side of the direction of travel of the high-frequency wave.

27. A fixing device according to claim 21, wherein said regulating means has cut-off means for cutting off the other area so that said effective area becomes equal to the size of the image bearing member.

28. A fixing device according to claim 25, 26 or 27, further comprising means for moving said cut-off means in accordance with the sizes of the image bearing members.

29. A fixing device according to any one of claims 19 or 21–27, further comprising means for controlling the frequency of the applied high-frequency wave.

30. A fixing device according to any one claims 19 or 21–27, further comprising means for controlling the voltage applied to the high-frequency wave generating means.

31. A fixing device according to claim 1, 14 or 19, wherein said high-frequency wave is microwave.

32. A fixing device according to claim 18 or 22, wherein said leakage region has a plurality of high-frequency wave leaking openings which are successively larger with respect to the direction of travel of the high-frequency wave.

33. A fixing device according to claim 18 or 22, wherein said leakage region has a plurality of high-frequency wave leaking openings provided at different densities with respect to the direction of travel of the high-frequency wave.

34. A fixing device according to claim 18 or 22, wherein said leakage region has electrode members provided at such intervals that they are successively smaller with respect to the direction of travel of the high-frequency wave.

35. A fixing device according to claim 18 or 22, wherein said leakage region comprises an electrode having a plurality of openings therein.

36. A fixing device according to claim 18 or 22, wherein said wave guide means has a dielectric material and a conductor.

* * * * *

UNITED STATES PATENT AND TRADEMARK OFFICE

CERTIFICATE OF CORRECTION

PATENT NO. : 4,511,778

DATED : April 16, 1985

INVENTOR(S) : TOHRU TAKAHASHI, ET AL.

It is certified that error appears in the above-identified patent and that said Letters Patent is hereby corrected as shown below:

Column 3, line 55, after "standard" insert --or reference--.

Column 4, line 5, "19" should read --18--.

Column 8, lines 1 and 2, "extinguish" should read --extinguishing--.

Column 11, line 47, "of" should read --or--.

Column 16, line 8,Claim 30, after "any one" insert --of--.

Signed and Sealed this

*Fourth* Day of *March 1986*

[SEAL]

*Attest:*

DONALD J. QUIGG

*Attesting Officer*

*Commissioner of Patents and Trademarks*